US006046441A

United States Patent [19]

Daffron

[11] Patent Number: 6,046,441

[45] Date of Patent: Apr. 4, 2000

[54] COMBUSTION ACTIVATED DEVICE FOR DISABLING AN ELECTRICAL APPLIANCE

[76] Inventor: Thomas Robert Daffron, 29135 Rivergate Run, Wesley Chapel, Fla. 33543

[21] Appl. No.: 09/072,456

[22] Filed: May 5, 1998

[51] Int. Cl.[7] ..... H05B 1/02

[52] U.S. Cl. ..... 219/506; 219/413; 219/481; 219/494; 340/628; 307/117

[58] Field of Search ..... 219/481, 497, 219/502, 506, 494, 412–414; 340/628–630; 307/116, 117

[56] References Cited

U.S. PATENT DOCUMENTS 3,176,754 4/1965 Macios .
4,070,670 1/1978 Chen .
4,577,181 3/1986 Lipscher et al. .
5,218,951 6/1993 Chak .
5,375,585 12/1994 Home .
5,400,766 3/1995 Dillon .

*Primary Examiner*—Mark Paschall
*Attorney, Agent, or Firm*—Kenneth L Tolar

[57] ABSTRACT

The present invention relates to a device for automatically disabling power to an electrical appliance as a fire erupts. The device includes a plurality of combustion product gas sensors disposed within or proximal to an electrical appliance each in communication with an audible alarm and an electrical contactor via a relay. The electrical contactor is received within an auxiliary plug which is coupled with the appliance plug such that, when the sensors detect a predetermined concentration of carbon dioxide or carbon monoxide, the contactor opens to disable power to the appliance and an audible alarm is simultaneously emitted.

7 Claims, 2 Drawing Sheets

COMBUSTION ACTIVATED DEVICE FOR DISABLING AN ELECTRICAL APPLIANCE

BACKGROUND OF THE INVENTION

The present invention relates to a safety device for disabling an electrical appliance upon sensing combustion gases typically emitted by a fire.

DESCRIPTION OF THE PRIOR ART

Heat producing appliances such as conventional and microwave ovens or stoves pose a significant fire hazard. Food items being cooked in an oven or stove are often left unattended for extended durations. If a fire develops when the user is absent, the appliance will continue to generate heat, further fueling the combustion process. By the time the user discovers that a fire is occurring, the fire has often spread out of control. If, however, power to the appliance is quickly disabled, a more severe electrical fire is less likely and the fire will be easier to control. Accordingly, there is currently a need for a device which is capable of detecting a fire and instantly disabling power to one or more electrical appliances.

Although various disabling devices for appliances exist in the prior art, none relate to a device specifically designed to immediately disable power to an electrical appliance upon detecting a combustion by-product such as carbon dioxide. For example, U.S. Pat. No. 5,400,766 issued to Dillon relates to a gas stove safety valve assembly comprising a valve operable with a key so that only an authorized user can activate the gas burners.

U.S. Pat. No. 5,375,585 issued to Home relates to a safety valve for a gas range that is disposed between the gas supply and burner. A thermocouple is placed near the burner which is in electrical communication with the valve. When the thermocouple detects a temperature below a predetermined value, such as if the flame is extinguished, the thermocouple closes the valve.

U.S. Pat. No. 5,218,951 issued to Chak discloses a mirror selectively positioned so that a gas flame can be seen by the user to adjust the flame.

U.S. Pat. No. 4,577,181 issued to Lipscher, et al relates to an alarm system for an electric range that employs a pressure sensitive switch means to alert a user if a burner is energized without a pot thereon.

U.S. Pat. No. 4,070,670 issued to Chen relates to an automatic shut off and alarm for an electric or a gas stove comprising a water drop detector that selectively closes the gas supply line. The water drop detector may also be used in conjunction with an electric stove which will disconnect the stove from the electrical source upon detection of a predetermined amount of water.

U.S. Pat. No. 3,176,754 issued to Macios relates to a child proof safety control for a gas range which prevents operation of the burner controls unless the pilot burner is ignited.

As indicated above, none of the conventional devices relate to a means for disabling electrical power to an appliance according to the present invention. Although appliance disabling devices exist, their response time is significant. For instance, the device described in Chen, supra, requires that a food item boil over into a water drop detector before the appliance is disabled. The present invention relates to a device that can detect combustion by-products such as carbon dioxide and carbon monoxide and will immediately disable an electrical appliance concurrently therewith. Accordingly, the appliance will be disabled almost immediately after a fire erupts.

SUMMARY OF THE INVENTION

The present invention relates to a device for disabling power to an electrical appliance upon sensing a predetermined amount of combustion by-products such as carbon monoxide or carbon dioxide. The device comprises one or more combustion gas detectors, such as a carbon dioxide or carbon monoxide sensor, placed within or proximal to an electrical appliance. The sensors are electrically connected to an auxiliary plug having a circuit breaker mechanism therein. The auxiliary plug includes a male plug component for coupling with a standard wall receptacle and a female receptacle in communication therewith for receiving the male plug of the electrical appliance. An audible alarm is also in communication with the sensors for emitting an audible alarm when a fire erupts. Upon the sensors detecting a predetermined concentration of combustion gases, an audible alarm is emitted and a signal is sent to the circuit breaker mechanism thereby disabling power to the appliance. It is therefore an object of the present invention to provide an assembly that instantly disables an electrical appliance upon sensing a predetermined concentration of a combustion produced gas.

It is yet another object of the present invention to provide an assembly for disabling an electrical appliance which emits an audible alarm whenever a predetermined concentration of combustion produced gas is detected.

It is yet another object of the present invention to provide an assembly for disabling an electrical appliance that can detect a fire occurring within a cooking chamber of an appliance and immediately disable power thereto. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
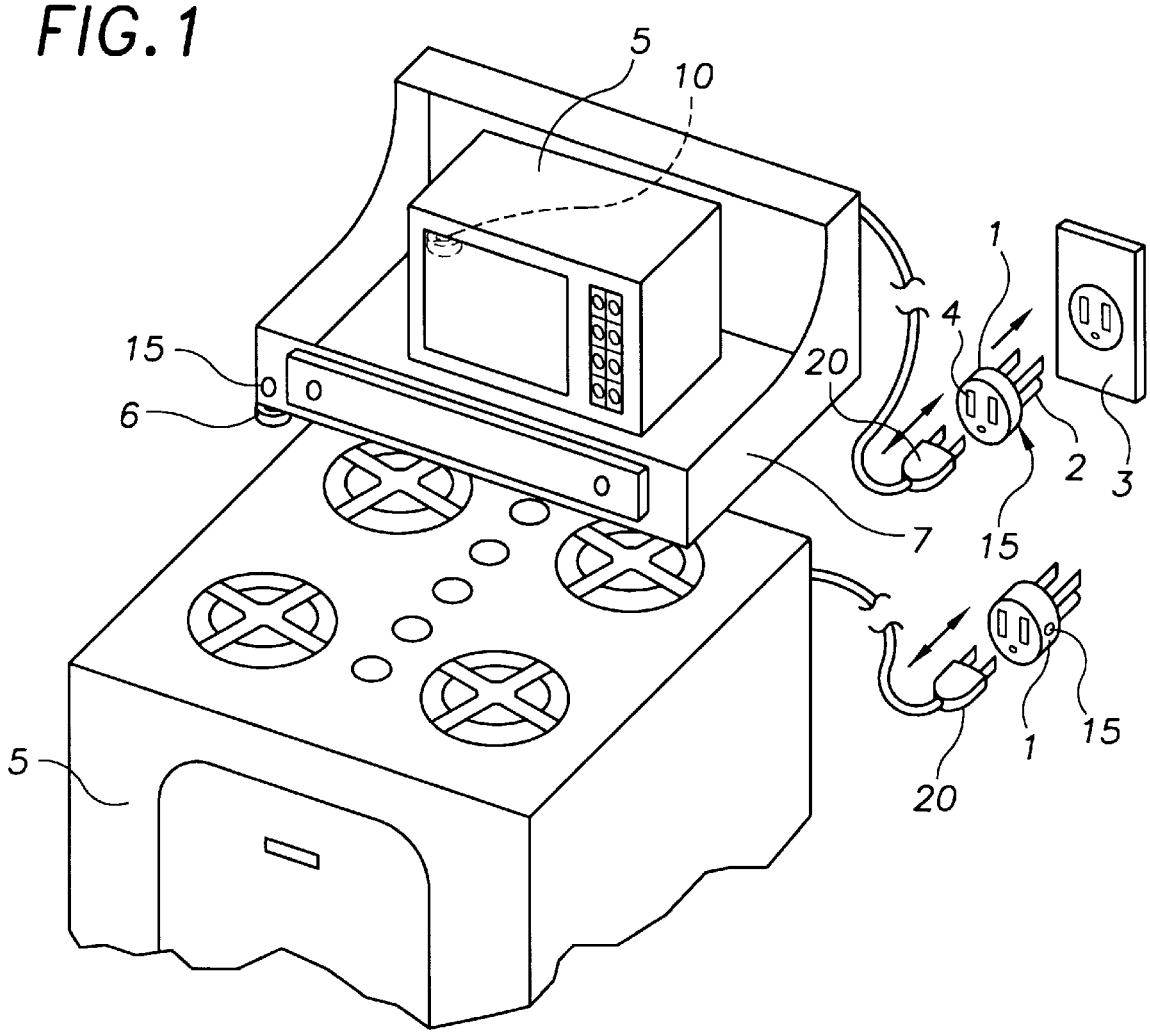
FIG. 1 depicts the assembly according to the present invention attached to a microwave oven and stove hood.
Figure 2:
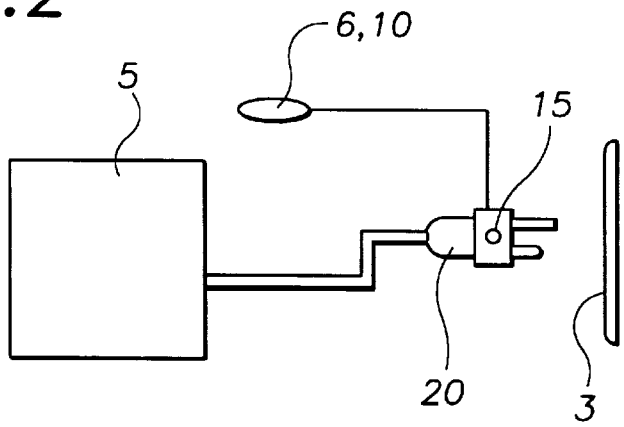
FIG. 2 is a schematic of the various components according to the present invention.
Figure 3:
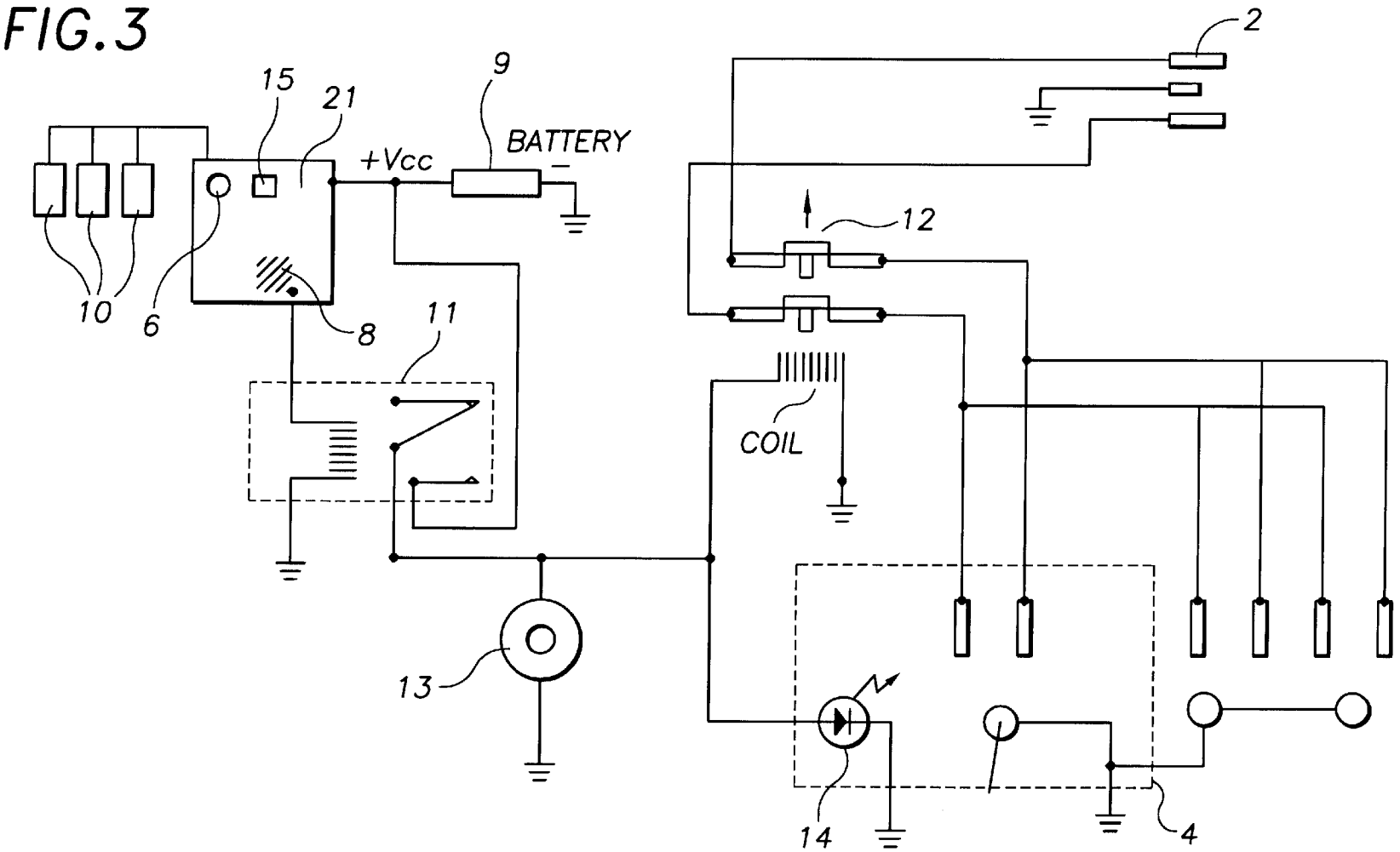
FIG. 3 is an electrical schematic of the various circuitry associated with the present invention.

Referring now to FIGS. 1 through 3, the present invention relates to a device for disabling an electrical appliance when a fire erupts. The device includes an auxiliary plug member 1 having male electrical prongs 2 on a side thereof for coupling with a conventional electrical wall receptacle 3. On an opposing side is a female electrical receptacle 4 electrically connected to the male prongs for receiving a standard male plug 20 on an electrical appliance 5. Within the plug is a circuit breaker mechanism for disabling power to the electrical device upon receiving a signal from a fire detection assembly described in more detail below.

The fire detection assembly comprises a plurality of carbon sensing means such as a conventional carbon monoxide or carbon dioxide detector. An external sensor 6 is preferably secured to an oven hood 7 or to a similar, convenient location proximal the stove, oven or microwave and is in communication with a first alarm means 8. A power source such a battery means 9 provides power to the external sensor. A plurality of remote sensors 10 are secured within the cooking chambers of conventional or microwave ovens or within similar heat producing appliances such as toaster ovens. The remote sensors 10 are electrically connected to the external sensor all of which are in communication with the alarm means 8 for emitting an audible alarm upon a sensor detecting a predetermined concentration of a carbon gas.

Referring now to FIG. 3, the circuit according to the present invention is depicted. The external and remote sensors are electrically connected to the first alarm means via a relay 11. Because the relay is also connected to the power source of the external sensor, the first alarm means, when triggered, will close the relay. A signal will then be delivered via the relay to the coil of a normally closed electrical contactor 12, sounding a second alarm means 13 and illuminating an LED 14. The normally closed contactor 12 is also in communication with the female receptacles on the auxiliary plug member. Accordingly, when a signal is delivered via the relay to the contactors, the contactors open disconnecting the electrical receptacles and the male prongs thereby disabling the electrical appliance.

The contactors may be reset to a closed position with a reset button 15 disposed on a side of the auxiliary plug member or on the external sensor housing 21. The contactors are preferably disposed within the auxiliary plug while the relay and alarm means are preferably disposed in a housing enclosing one of the sensors. Preferably, each sensor housing is constructed with a heat resistant material so that the sensor may be placed within an appliance cooking chamber. The auxiliary plug component may be constructed to receive a plurality of plugs so that several appliances may be simultaneously disabled or the plug may be configured to receive a single appliance.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A device for disabling an electrical appliance comprising:

a first combustion gas sensor disposed proximal a first electrical appliance;

a second combustion gas sensor mounted with a cooking chamber of a second electrical appliance;

a power disabling means electrically coupled with each of said first and second appliances, said combustion gas sensors and a power source for disabling electrical communication between said first and second appliances and said power source upon either of said combustion gas sensors detecting a predetermined concentration of a combustion gas.

2. A combustion activated device for disabling an electrical appliance comprising:

a carbon sensing means disposed proximal an electrical appliance;

a power disabling means electrically coupled with said appliance, said carbon sensing means and said power source for disabling electrical communication between said appliance and said power source upon said carbon dioxide sensor detecting a predetermined concentration of a carbon containing gas.

3. A device according to claim 2 further comprising an audible alarm means in communication with said carbon sensing means for audibly alerting a user when said sensing means has detected a predetermined concentration of a carbon containing gas.

4. A device according to claim 3 wherein said power disabling means comprises an auxiliary plug member coupled with said appliance power source having a receptacle for receiving a plug on said electrical appliance to establish selective communication between said appliance and said power source;

a normally closed contactor electrically connected to a said receptacle and said power source;

a relay in communication with said carbon sensing means and said contactor for selectively opening said contactor to disable power to said appliance.

5. A device according to claim 4 further comprising a light means in communication with said power disabling means for visually alerting a user that the disabling means has been activated.

6. A device according to claim 5 further comprising a reset means disposed on said carbon sensing means in communication with said power disabling means to reestablish power to said appliance.

7. A device according to claim 6 wherein said carbon sensing means is a carbon dioxide detector.

* * * * *